US011718101B2

(12) United States Patent
Matsuda

(10) Patent No.: US 11,718,101 B2
(45) Date of Patent: Aug. 8, 2023

(54) THERMAL PRINTER AND METHOD FOR CORRECTING PRINTING POSITIONS

(71) Applicant: TOSHIBA TEC KABUSHIKI KAISHA, Tokyo (JP)

(72) Inventor: Okiharu Matsuda, Susono Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/892,913

(22) Filed: Aug. 22, 2022

(65) Prior Publication Data

US 2022/0396080 A1 Dec. 15, 2022

Related U.S. Application Data

(62) Division of application No. 17/097,928, filed on Nov. 13, 2020, now Pat. No. 11,453,224.

(30) Foreign Application Priority Data

Jan. 8, 2020 (JP) ..... 2020-001367

(51) Int. Cl.
*B41J 2/325* (2006.01)

(52) U.S. Cl.
CPC ..... *B41J 2/325* (2013.01)

(58) Field of Classification Search
CPC ..... B41J 2/325
See application file for complete search history.

(56) References Cited

U.S. PATENT DOCUMENTS

2007/0055724 A1 3/2007 Harada et al.
2008/0205223 A1* 8/2008 Miyazaki ..... H04N 1/4015 369/53.12

FOREIGN PATENT DOCUMENTS

JP 2011167849 A 9/2011

OTHER PUBLICATIONS

Extended European Search Report dated May 14, 2021, mailed in counterpart European Application No. 20214960.5, 6 pages.

* cited by examiner

*Primary Examiner* — Justin Seo
(74) *Attorney, Agent, or Firm* — Kim & Stewart LLP

(57) ABSTRACT

An information process device according to an embodiment includes a thermal head that prints on paper at positions along a width direction based on a reference position. The sensor is at a sensor position in the width direction and detects marks on paper being conveyed by a conveyance unit. The controller controls the conveyance unit to convey a confirmation sheet and then detects a position of a mark on the confirmation sheet with the sensor. The detected position corresponds to the sensor position. The controller next controls the conveyance unit and the thermal head to print a line on a sheet corresponding to the sensor position. The controller is configured to receive a corrected sensor position based on a measured distance of the printed line to an edge of the sheet and update the print reference position accordingly.

11 Claims, 12 Drawing Sheets

THERMAL PRINTER AND METHOD FOR CORRECTING PRINTING POSITIONS

CROSS-REFERENCE TO RELATED APPLICATION

This application is a division of U.S. patent application Ser. No. 17/097,928, filed on Nov. 13, 2022, which is based upon and claims the benefit of priority from Japanese Patent Application No. 2020-001367, filed on Jan. 8, 2020, the entire contents of each of which are incorporated herein by reference.

FIELD

Embodiments described herein relate generally to a thermal printer and a method for correcting printing positions.

BACKGROUND

A thermal printer performs printing by using thermal energy to drive a plurality of heating elements arranged on a line of a thermal head. In such a thermal printer, if there is an error in the assembly position (e.g., with use over time or due to manufacturing defects or tolerances) of the thermal head, a positional deviation will occur in the resulting image printed on the paper, and thus the print quality is decreased. Specifically, if the assembly position of the thermal head deviates in the paper width direction (main deflection direction), the image printed on the paper deviates in the width direction of the paper from the position intended to be printed.

In order to solve this problem, the print position is corrected to compensate for the assembly error of the thermal head. For example, the thermal printer may print a straight line with the assembled thermal head and a sensor may then detect relative positions of the printed straight line and an edge of the paper being printed. Then, the detected relative position and the designed (intended) relative position between the head and the paper edge are compared with each other to recognize and measure the assembly error If an assembly error is recognized, the print position can be corrected (see for example JP-A-2011-167849).

In the configuration of related art, in order to recognize the assembly error of the thermal head, a sensor is required to detect the relative position of the line printed with the thermal head and the paper edge. A simplified configuration would be preferred for correcting the print position to account for an assembly error of the thermal head.

DETAILED DESCRIPTION

Embodiments provide a thermal printer and a method that can correct print position errors that can be due to assembly errors involving a thermal print head.

In general, according to one embodiment, a thermal printer includes a conveyance unit configured to convey paper along a conveyance direction and a thermal head configured to perform printing on the paper at positions along a width direction of the paper intersecting the conveyance direction of the paper. The print positions along the width direction being based on a print reference position. A sensor is positioned at a sensor position in the width direction and configured to detect marks on the paper being conveyed by the conveyance unit. A controller is configured to: control the conveyance unit to convey a confirmation sheet along the conveyance direction; detect a position of a mark in a predetermined pattern on the confirmation sheet with the sensor, the detected position of the mark corresponding to the sensor position with respect to the print reference position; control the conveyance unit to convey a sheet, and control the thermal head to print a line on the sheet along the conveyance direction at the sensor position in the width direction; receive a corrected sensor position based on a measured distance of the line on the sheet to an edge of the sheet; and update the print reference position based on the received corrected sensor position.

First Embodiment

Figure 1:
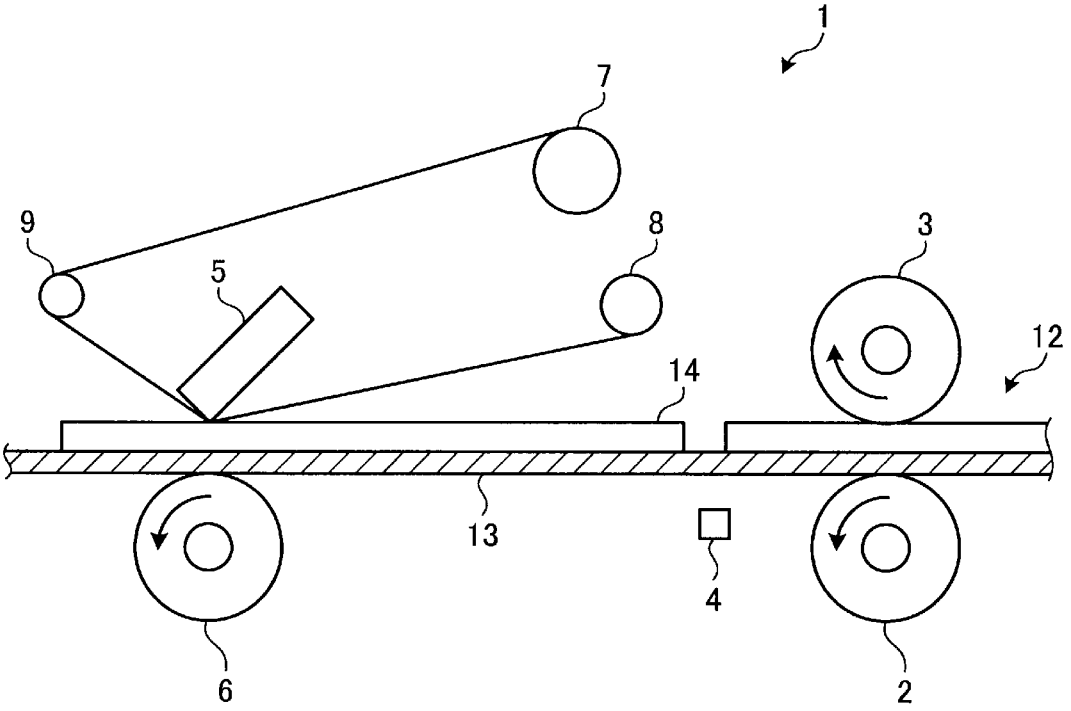
FIG. 1 is a diagram illustrating a partial configuration of a thermal printer of a first embodiment.
Figure 2:
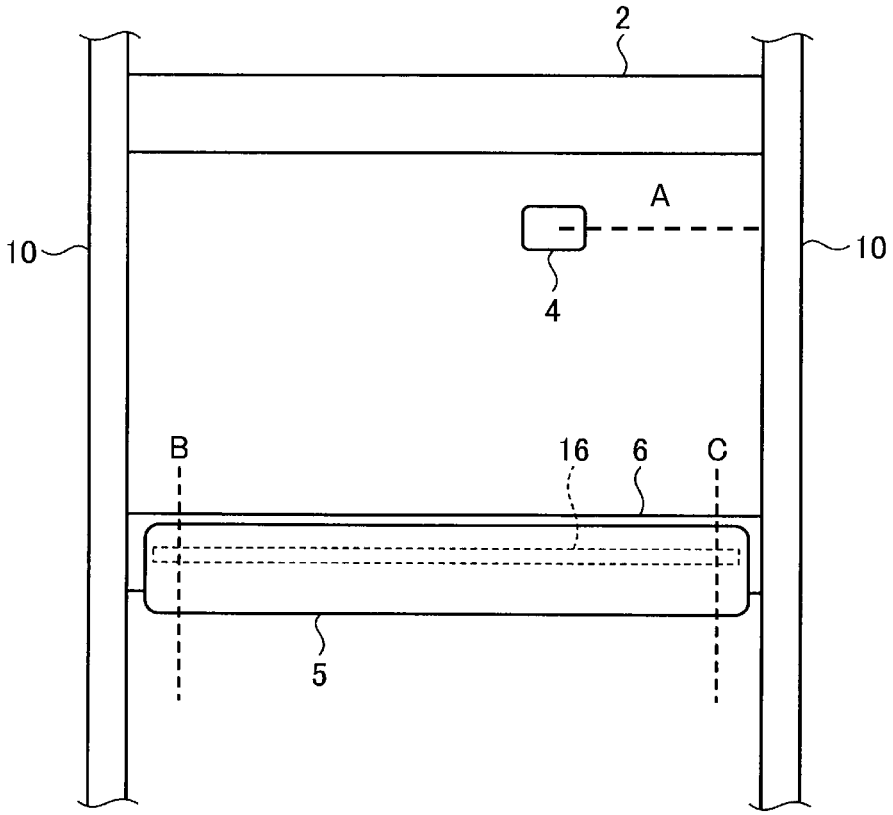
FIG. 2 is a diagram illustrating a positional relationship with respect to a sensor, paper guides, and a thermal head of a first embodiment.

Hereinafter, a thermal printer of certain example embodiments will be described with reference to the drawings. FIGS. 1 and 2 are diagrams illustrating a portion of a configuration of a thermal printer 1. The thermal printer 1 includes a conveyance roller 2, a driven roller 3, a sensor 4, a thermal head 5, a platen roller 6, an ink ribbon holding portion 7, an ink ribbon winding portion 8, a guide roller 9, and a pair of paper guides 10. The thermal printer 1 according to the present embodiment is a label printer used for label printing.

The conveyance roller 2 is provided to extend between the pair of paper guides 10 and driven by a conveyance motor 11 (see FIG. 5) including a stepping motor. The driven roller 3 is extends between the pair of paper guides 10 in the same manner as the conveyance roller 2 and to face the conveyance roller 2. The driven roller 3 and the conveyance roller 2 interpose label paper 12 therebetween to convey the label paper 12 by rotation. A conveyance unit that conveys paper is formed by the conveyance roller 2, the driven roller 3, the conveyance motor 11, and the like.

The paper guides 10 are movable (adjustable) in a width direction so that the distance between the pair of paper guides 10 can vary accommodate label paper 12 of different widths.

Figure 3:
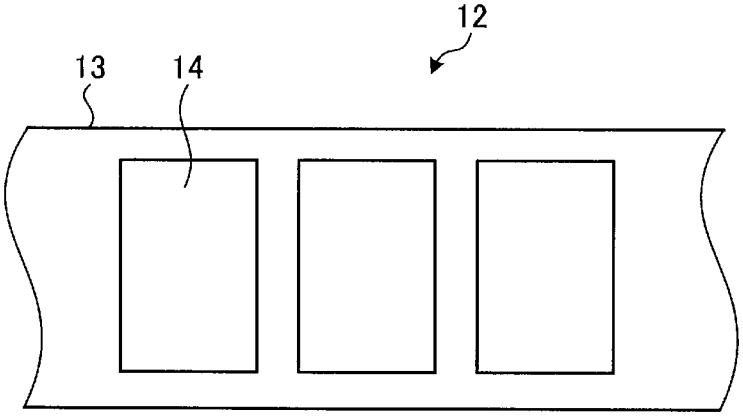
FIG. 3 is a diagram illustrating an upper surface of label paper used in the thermal printer of a first embodiment.
Figure 4:
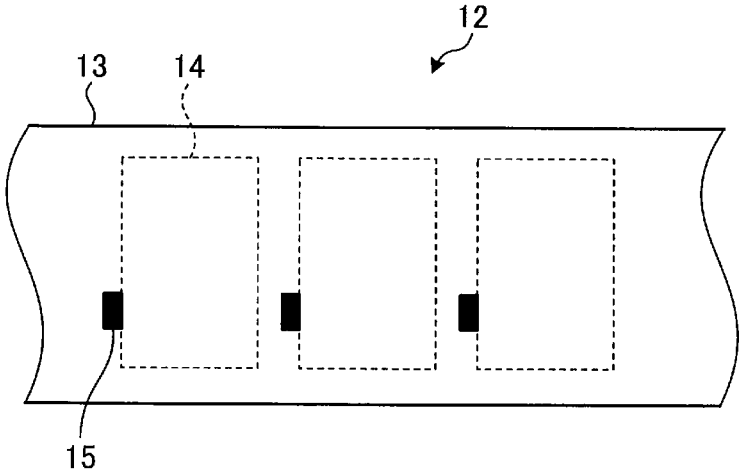
FIG. 4 is a diagram illustrating a lower surface of the label paper used in the thermal printer of a first embodiment.

As illustrated in FIG. 3, the label paper 12 includes amount 13 (also referred to as a label backing sheet) and a plurality of labels 14 attached to the front surface of the mount 13 at predetermined intervals. As illustrated in FIG. 4, on the back surface of the mount 13, black marks 15 are printed corresponding to leading edge positions of the labels 14 (which are on the front surface) in the conveyance direction.

In FIGS. 1 and 2, sensor 4 is positioned on a downstream side in a conveyance direction of the label paper 12 with respect to the conveyance roller 2. An upstream side is in a direction opposite of the downstream side. The sensor 4 is provided at a position that is slightly deviated from the centerline position in the width direction between the pair of paper guides 10 to be at a position that faces the back surface of the conveyed label paper 12. Referring to FIG. 2, a distance from the center of the sensor 4 in the width direction to the paper guide 10 nearest the sensor 4 is referred to as A. The distance A is not a value entirely determined by design, but rather is a value including assembly errors in the sensor 4 and/or the paper guides 10.

In this example, the sensor 4 is a reflective sensor that includes a light emitting element and a light receiving element and can detect the marks 15 on the label paper 12 by the detection of reflected light therefrom. For example, the light emitting element emits light that is reflected from the back surface of the label paper 12 and this reflected light is received by the light receiving element of the sensor 4. The sensor 4 is not limited to any particular design or type as long as a printed mark 15 can be detected by the sensor 4.

The control unit of the thermal printer 1 recognizes leading edge positions of the labels 14 according to the sensor 4 detecting the marks 15 and controls the conveyance motor 11 to move from label 14 to label 14 based on the recognition of these leading edge positions of the labels 14. That is, the thermal printer 1 detects the positions of the labels 14 to be printed using the sensor 4 and conveys the labels 14 to a printing position of the thermal head 5 for printing. As such, the sensor 4 is an integral component of a printer that performs printing on labels 14 and, as such, is typically included in a thermal printer for this purpose. The sensor 4 can move or be moved along the width direction to deal with varied potential positions of the marks 15 according to the different types, brands, and/or sizes of label paper 12 or the like that might be used in the thermal printer 1.

The thermal head 5 is provided on the downstream side of the sensor 4. The thermal head 5 performs the printing using a preset print reference position along the width direction of the thermal head 5. The preset print reference position can be set as a distance from one paper guide 10. The thermal head 5 is a linear thermal head including a plurality of heating elements 16 distributed along the width direction. The print area of the thermal head 5 in the width direction is between a print start position B and a print end position C, illustrated in FIG. 2. The portion of the heating elements 16 which are not in the print area are not used in the initial setting of thermal print head 5. In the present embodiment, the print start position B is set to the preset print reference position along the width direction.

The thermal head 5 performs printing on a label 14 by generating heat using at least some of the heating elements 16 and vaporizing or melting ink included in an ink ribbon. The thermal head 5 can move between a print position that presses against the platen roller 6 and a non-print position that is separated from the platen roller 6. A user can cause the thermal head 5 to be positioned at the non-print position to remove or install paper rolls or an ink ribbon. The platen roller 6 is driven by the conveyance motor 11.

The ink ribbon holding portion 7 holds a roll of unused ink ribbon. The ink ribbon winding portion 8 is rotated by a winding motor (not separately illustrated) to wind the ink ribbon. The guide roller 9 guides the ink ribbon from the ink ribbon holding portion 7 to the ink ribbon winding portion 8 past the thermal head 5.

Figure 5:
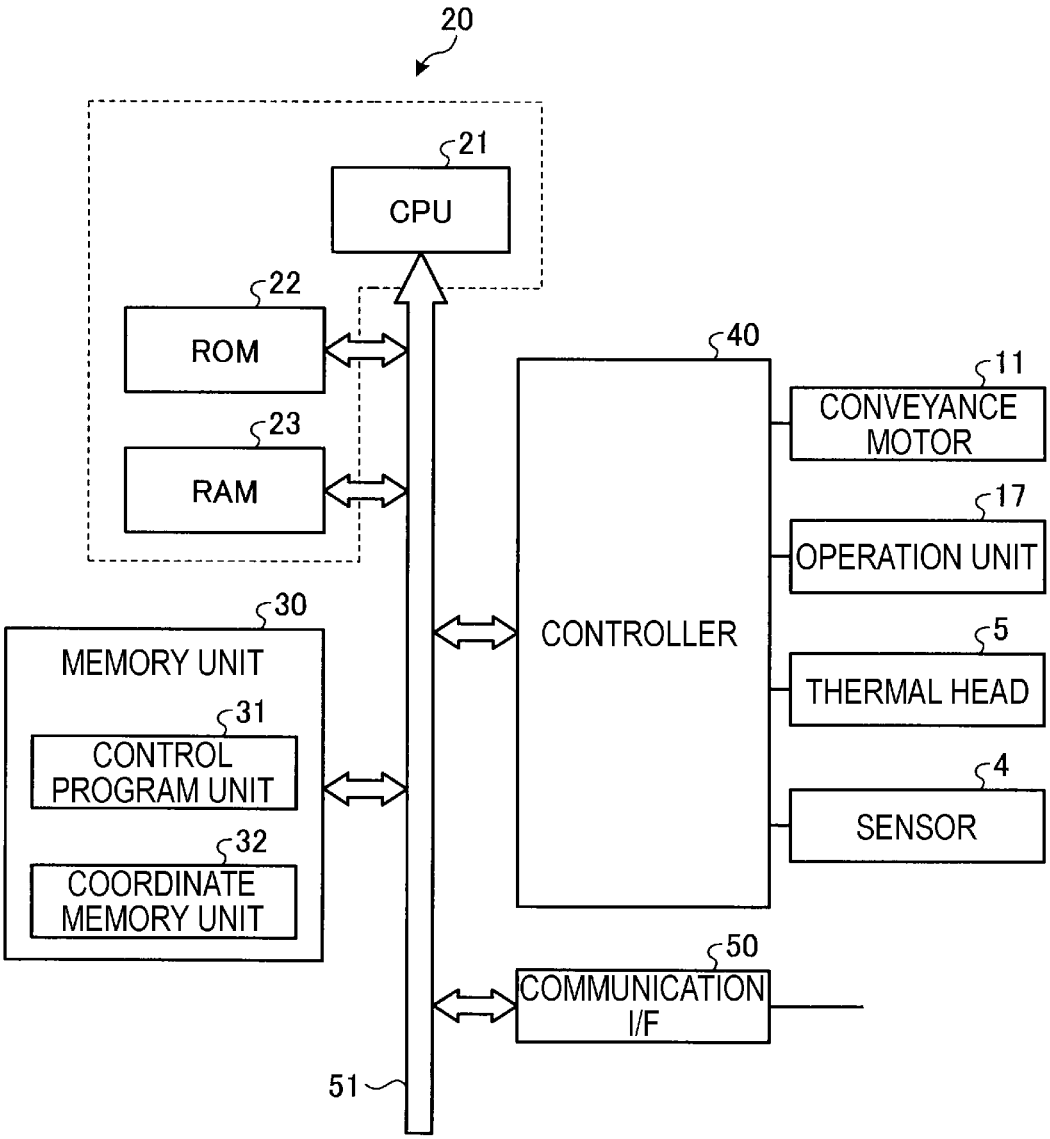
FIG. 5 is a block diagram illustrating a hardware configuration of the thermal printer of a first embodiment.

With reference to FIG. 5, a hardware configuration of the thermal printer 1 is described. The thermal printer 1 includes a control unit 20, a memory unit 30, a controller 40, and a communication interface (I/F) 50. The control unit 20, the memory unit 30, the controller 40, and the communication I/F 50 are connected to each other via a bus 51.

The control unit 20 includes a central processing unit (CPU) 21, a read only memory (ROM) 22, and a random access memory (RAM) 23. The CPU 21, the ROM 22, and the RAM 23 that are connected to each other via the bus 51.

The CPU 21 controls an operation of the thermal printer 1. The ROM 22 stores various program or various data such as a program used for driving the CPU 21. The RAM 23 is used as a work area of the CPU 21 and can load various programs or various data from the ROM 22 or the memory unit 30. The control unit 20 performs various control processes of the thermal printer 1 by the CPU 21 executing the control program stored in the ROM 22 or the memory unit 30 and then loaded in the RAM 23.

The memory unit 30 includes therein a control program unit 31, and a coordinate memory unit 32. The control program unit 31 stores various control programs in addition to the control program for functions of the thermal printer 1.

The coordinate memory unit 32 stores data relating to marks of predetermined patterns such as a mark of a first predetermined pattern and a mark of a second predetermined pattern.

Figure 6:
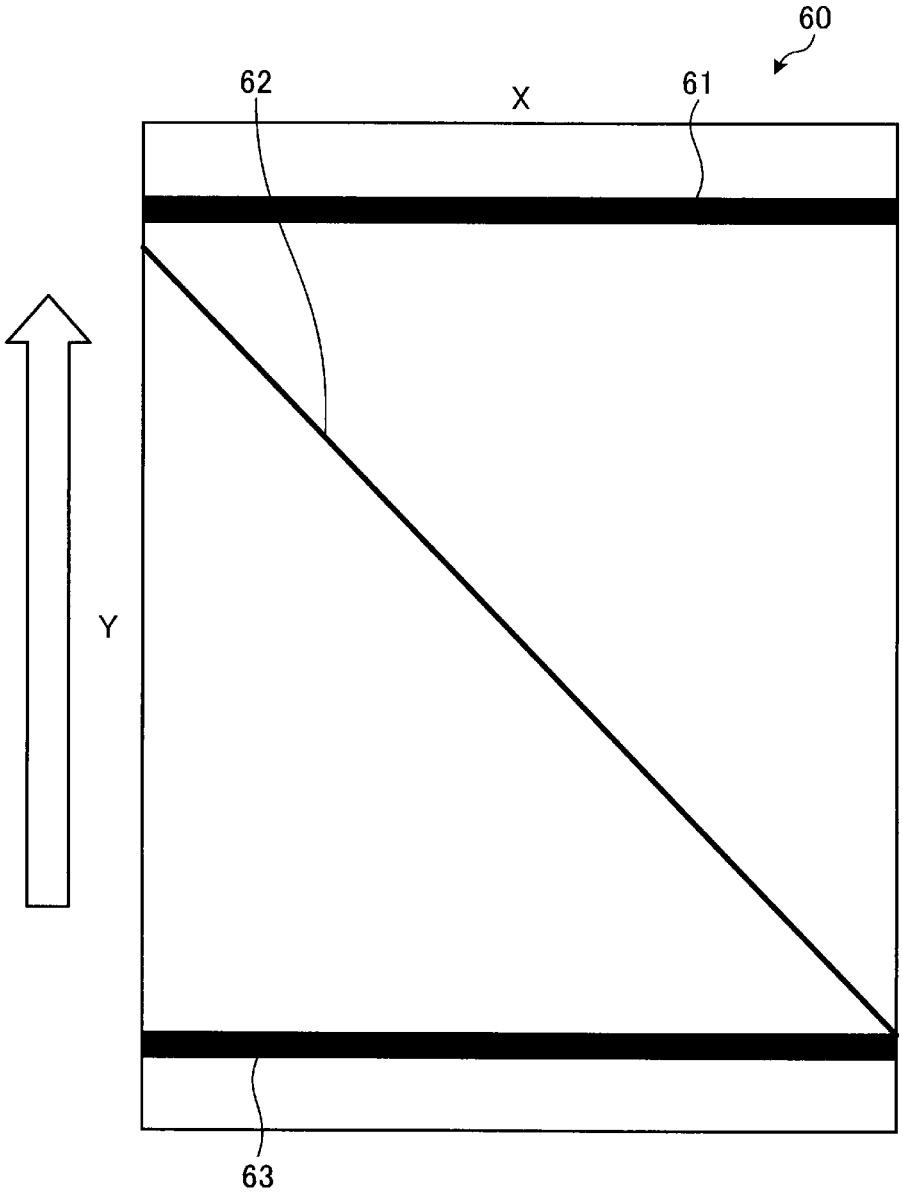
FIG. 6 is a diagram illustrating a position confirmation sheet of a first embodiment.

An example of a position confirmation sheet 60 on which the first predetermined pattern has been printed is illustrated in FIG. 6. In FIG. 6, the printed marks include a start mark 61, a position detection mark 62, and an end mark 63. In this case, these various marks are printed in black.

The start mark 61 is a straight line that is positioned on the upstream side in the conveyance direction Y of the position confirmation sheet 60 and extends across the position confirmation sheet 60 in the width direction X. The position detection mark 62 is a diagonal line printed on the downstream side of the start mark 61. The position detection mark 62 is a diagonal line for which the distance from the start mark 61 constantly changes with distance along the width direction from the paper edge of the position confirmation sheet 60 one to one. The position detection mark 62 is not necessarily limited to a diagonal line as long as the distance between the position detection mark 62 and the start mark 61 along the conveyance direction corresponds in a known manner to position along the width direction so the detection of the position detection mark 62 after the detection of the start mark 61 using the sensor 4 can be converted to a distance in the width direction from the paper edge. The end mark 63 is a straight line that is positioned on the downstream side of the position detection mark 62 in the conveyance direction Y and extends in the width direction X.

With respect to the positioning of the position detection mark 62, the coordinate memory unit 32 stores the coordinate data correlating to the distance in the conveyance direction Y from the start mark 61 and the distance in the width direction X from one of the paper guides 10 (hereinafter, also referred to as the reference paper guide 10). Accordingly, if the distance from the start mark 61 to the position detection mark 62 in the conveyance direction Y is identified/measured, then the corresponding distance in the width direction X from the reference paper guide 10 can be specified by reference to the stored coordinate data or the like. The coordinate memory unit 32 is also able to store the coordinate data for the second predetermined pattern described further below.

The controller 40 is connected to the conveyance motor 11, an operation unit 17, the thermal head 5, and the sensor 4. Accordingly, the control unit 20 can transmit and receive information (data) to and from the conveyance motor 11, the operation unit 17, the thermal head 5, and the sensor 4 via the controller 40. The communication I/F 50 is an interface for communication with an external device. For example, the communication I/F 50 can communicate with an external computer that transmits print data.

Figure 7:
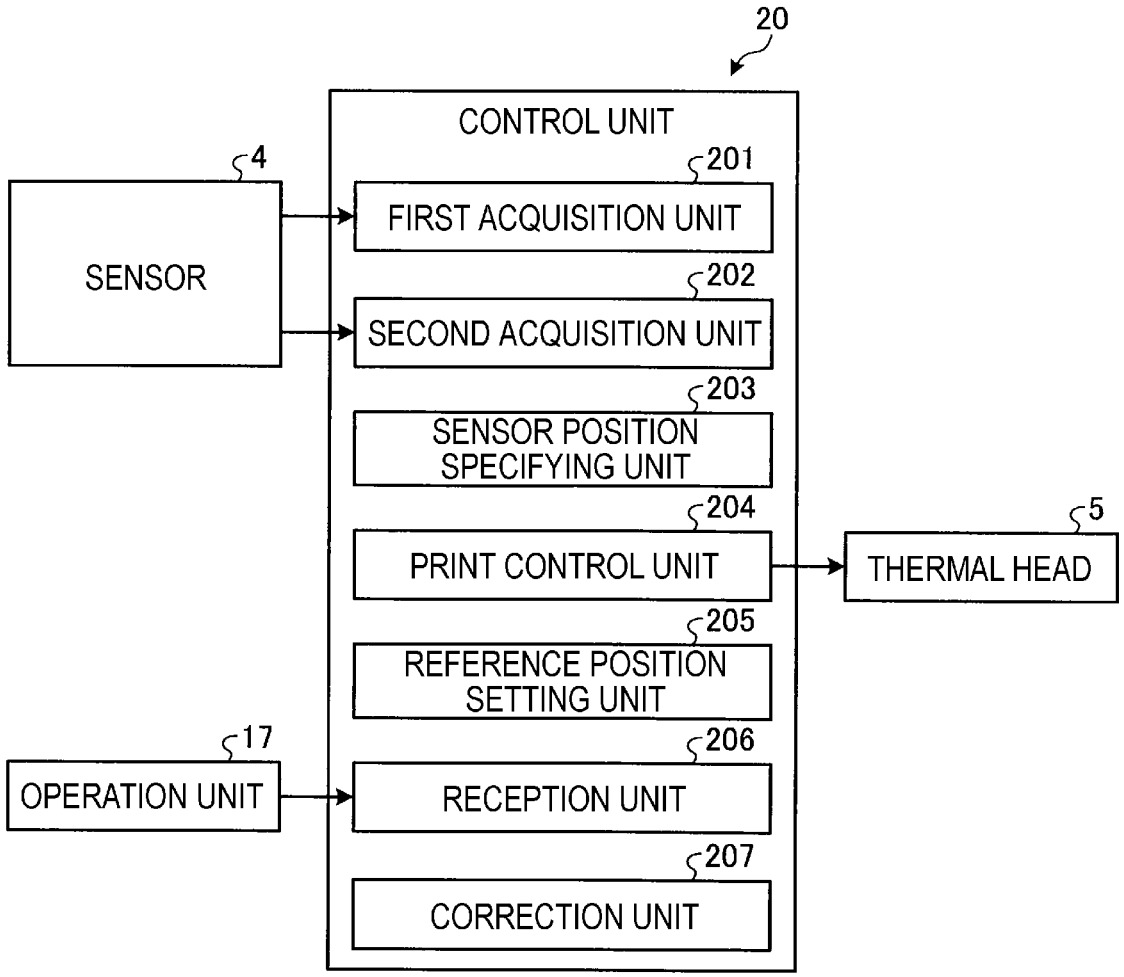
FIG. 7 is a block diagram of a thermal printer of a first embodiment.

The functional configuration of the thermal printer 1 is described with reference to FIG. 7. By way of operation of CPU 21 according to the control program unit 31 of the ROM 22, the control unit 20 performs as a first acquisition unit 201, a second acquisition unit 202, a sensor position specifying unit 203, a print control unit 204, a reference position setting unit 205, a reception unit 206, and a correction unit 207. These functions can also, or instead, be implemented in hardware.

The first acquisition unit 201 acquires the first detection information from the sensor 4 detecting the marks from a paper, for example, a paper including the marks of a first predetermined pattern. Specifically, the first acquisition unit 201 acquires the detection information by the sensor 4 detecting the position detection mark 62 of a pre-printed, or otherwise pre-prepared, position confirmation sheet 60. That is, a position confirmation sheet 60 includes the first predetermined pattern (see FIG. 6) formed thereon. According to the present embodiment, the first acquisition unit 201 acquires information indicating the distance from the start mark 61 to detection mark 62 as detected by the sensor 4. For example, the information is a travel distance of the position confirmation sheet 60 between detections of the start mark 61 and the position detection mark 62 by the sensor 4.

The second acquisition unit 202 relates more specifically to the second embodiment discussed further below and functions to acquire second detection information obtained by the sensor 4 detecting a mark from a paper on which a second predetermined pattern or portions thereof has been printed with the thermal head 5. The second detection information is also information indicating the distance from the start mark 61 to detection mark 62 as detected by the sensor 4.

The sensor position specifying unit 203 identifies the position of the sensor 4 in the width direction X by referring to the detection information acquired by the first acquisition unit 201 and the second acquisition unit 202 and stored in coordinate memory unit 32. That is, the sensor position specifying unit 203 calculates the position of the sensor 4 in the width direction X based on the distance from the start mark 61 to the detection mark 62 in the first predetermined pattern as detected by the sensor 4.

The print control unit 204 next controls the thermal head 5 so that a mark is printed at the width direction position of the sensor 4 calculated based on the detection information acquired by the acquisition unit. Specifically, the print control unit 204 controls the thermal head 5 or the conveyance unit so that the straight line is printed along the conveyance direction Y at the position in the width direction X of the sensor 4 specified by the sensor position specifying unit 203 based on the detection information acquired by the first acquisition unit 201. The print control unit 204 then controls the thermal head 5 or the conveyance unit so that the second predetermined pattern can be printed in response to the operation of the operation unit 17. If a print instruction is received from an external computer, the print control unit 204 controls the thermal head 5 to perform printing.

The reference position setting unit 205 sets the print reference position of the thermal head 5. In the present embodiment, the print reference position is the print start position B (see FIG. 2). If the print start position B is set, heating elements 16 positioned between the print start position B and the print end position C are used to perform printing. Assuming that the thermal printer 1 is assembled according to design, the reference position setting unit 205 sets the print reference position based on the width of the paper, the print area, and the like which can be input by the operation unit 17.

The reception unit 206 receives a correction of the print reference position. Specifically, the reception unit 206 receives the instruction that corrects the print reference position set by the reference position setting unit 205 from the operation unit 17. The reception unit 206 receives other various instructions from the operation unit 17.

Figure 8:
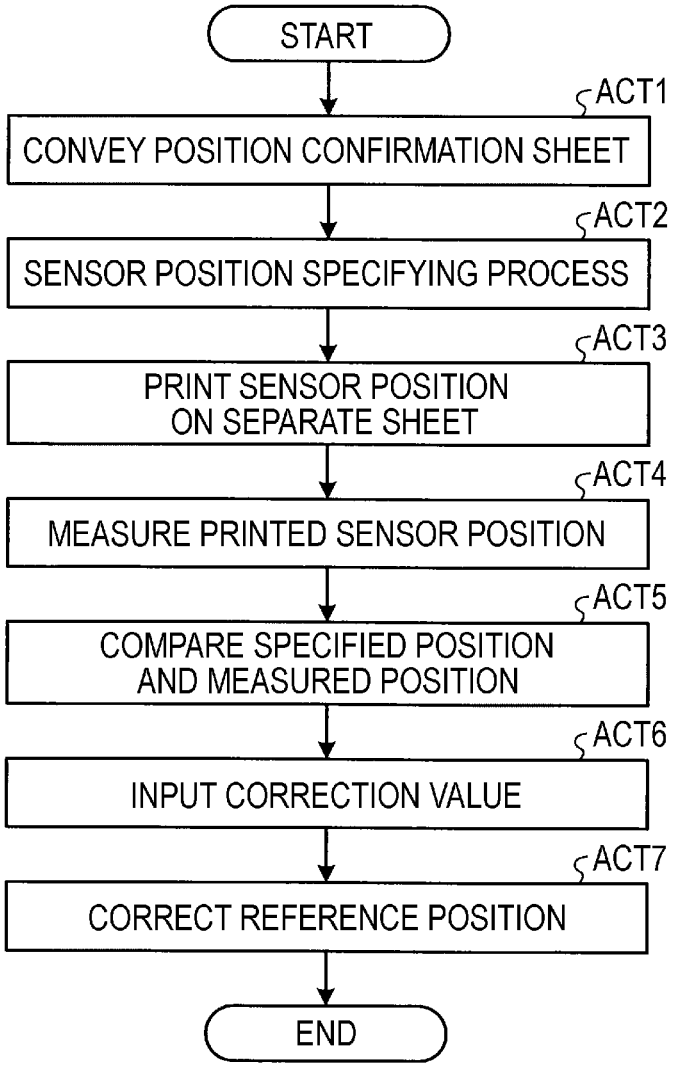
FIG. 8 is flowchart of a correction process in a thermal printer of a first embodiment.

The flow of the correction process for correcting the print reference position based on the configuration is described with reference to FIG. 8. The correction process corrects the positional deviation of the print reference position that is caused by assembly error of the thermal head 5. The correction process can be performed, for example, by a person in charge of the product before factory shipment. The correction process can also be performed by a user (end user) who purchases the thermal printer 1, for example, after the replacement of the thermal head 5 or the like.

In order to perform the correction process, the person in charge of the product or the end user (hereinafter, referred to collectively as the user) operates the operation unit 17 for instruction of the correction process, sets the position confirmation sheet 60, illustrated in FIG. 6, such that the marks 61 to 63 face the sensor 4, and conveys the position confirmation sheet 60 with the conveyance unit (Act 1). Then, the control unit 20 performs a sensor position specifying process (Act 2). The sensor position specifying process is a process performed by the control unit 20 in order to identify the width direction position of the sensor 4 with respect to the reference paper guide 10 by the sensor 4 detecting the position detection mark 62 printed on the position confirmation sheet 60.

Figure 9:
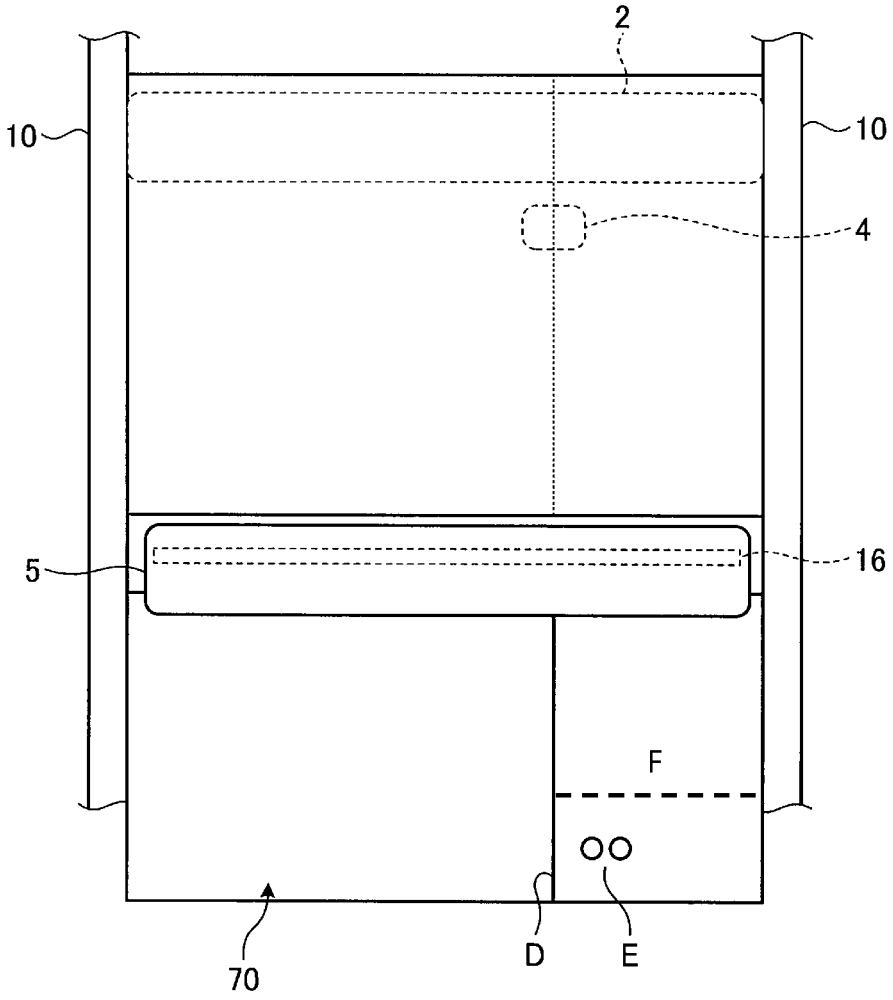
FIG. 9 is a diagram of a paper on which a sensor position is printed according to a first embodiment.

The user next loads or sets separate paper 70 (see FIG. 9) having the same size as the position confirmation sheet 60 on the thermal printer 1 and performs the print instruction with the operation unit 17. Then, the print control unit 204 controls the thermal head 5 such that a straight line is printed along the conveyance direction Y at the position in the width direction X specified in the sensor position specifying process of Act 2. As illustrated in FIG. 9, the thermal head 5 prints a straight line D along the conveyance direction Y of the paper 70 (Act 3). That is, the thermal head 5 prints the straight line D at the position of the sensor 4 with the reference paper guide 10 set as a reference. The thermal head 5 prints, for example, a mark E between the straight line D and reference paper guide 10 as the information indicating the position in the width direction X specified in the sensor position specifying process. The mark E can be printed to include a numerical value such as XX millimeters.

The user extracts paper 70 printed in Act 3 and measures a distance F from the printed straight line to the paper edge closest to the straight line D (Act 4). Subsequently, the user compares the printed mark E value with the measured distance F, that is, compares the sensor position specified in the sensor position specifying process of Act 2 with the measured position of the straight line from the paper edge (Act 5). The mark E information need not necessarily be printed on the paper but may instead be displayed on a display device included in the thermal printer 1. According to the comparison, it is possible to know whether there is an assembly error of the thermal head 5. Specifically, the mark E printed as a numerical value corresponds to a position at which the print control unit 204 considers the sensor 4 to be located in relation to the thermal head 5, while the distance F that as measured corresponds to the actual position of the sensor 4 in relation to the assembled thermal head 5. Accordingly, if there is no difference between the mark E value and the measured distance F, the thermal head 5 can be considered to have been attached without any error or deviation from design. However, if there is a difference between the mark E value and the distance F, then there is an assembly error or deviation from design position of the thermal head 5.

As a result of the comparison in Act 5, if there is a difference between the mark E value and the distance F, an assembly error of the thermal head 5 in the width direction is considered to have occurred. Thus, the user can correct the print start position setting to account for the assembly error. Specifically, the user operates the operation unit 17 to input the difference between the mark E value and the distance F as a correction value (Act 6). The reception unit 206 receives the correction value, and the correction unit 207 corrects the print reference position setting in the reference position setting unit 205 based on the correction value. Accordingly, the user can correct the print start position.

Figure 10:
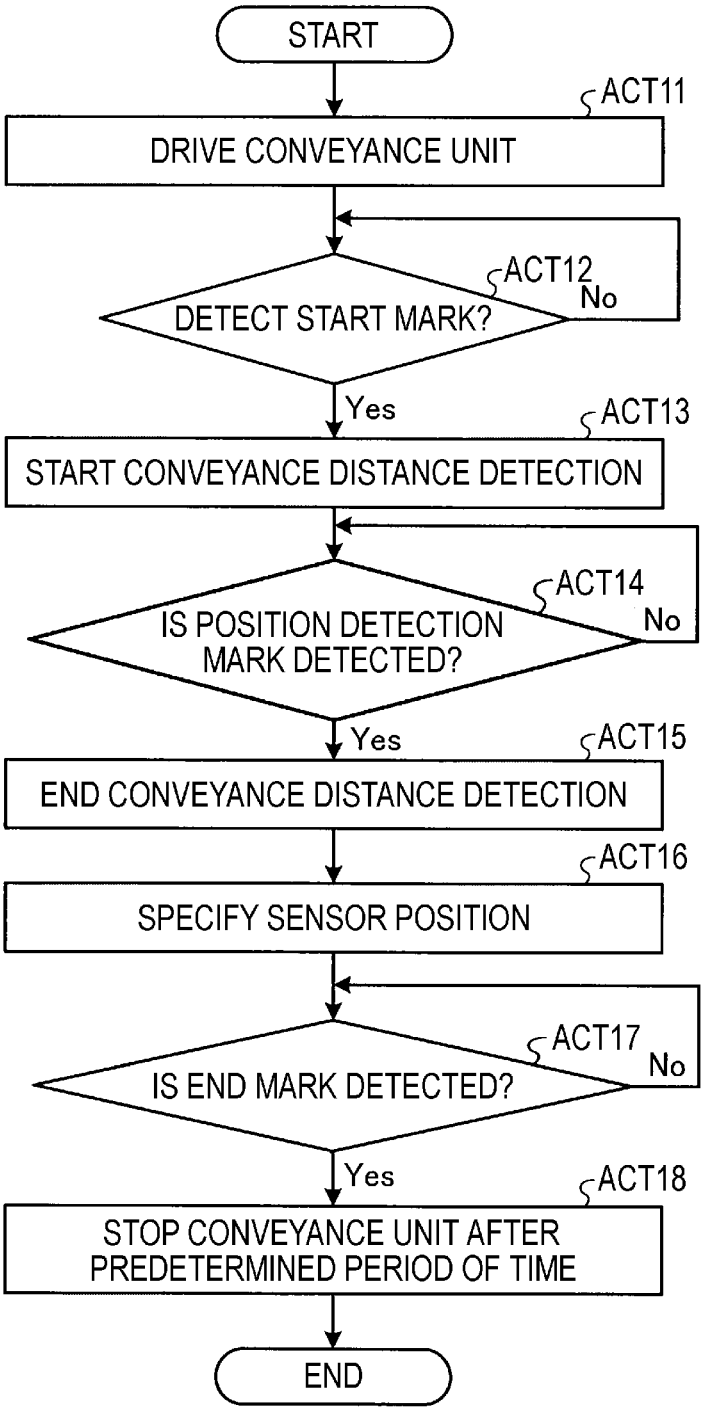
FIG. 10 is a flowchart of a process of a control unit according to a first embodiment.

The sensor position specifying process in Act 2, which is performed by the control unit 20, is described with reference to the flowchart of FIG. 10.

First, the control unit 20 drives the conveyance motor 11 for the conveyance unit (Act 11). Subsequently, the control unit 20 determines whether the sensor 4 detects the start mark 61 on the position confirmation sheet 60 (Act 12). After the starting of driving the conveyance unit, the control unit 20 determines that the first mark detected by the sensor 4 is the start mark 61. In other words, after the start of driving the conveyance unit, the first detection signal is input to the first acquisition unit 201, the control unit 20 considers the start mark 61 to have been detected.

After the sensor 4 detects the start mark 61 (Yes in Act 12), the control unit 20 starts the detecting (or measuring) of the conveyance distance of the position confirmation sheet 60 (Act 13). If the sensor 4 does not detect the start mark 61 (No in Act 12), the control unit 20 repeats the process of Act 12.

The control unit 20 next determines whether the sensor 4 has detected the position detection mark 62 (Act 14). The control unit 20 considers the next mark detected by the sensor 4 after the start mark 61 has already been detected to be the position detection mark 62. In other words, after the control unit 20 detects the start mark 61, the next detection signal input to the first acquisition unit 201 is treated by the control unit 20 as being related to the position detection mark 62.

Once the sensor 4 detects the position detection mark 62 (Yes in Act 14), the control unit 20 ends the conveyance distance detection (Act 15), and the sensor position specifying unit 203 specifies the sensor position based on the measured/detected conveyance distance between the start mark 61 and the position detection mark 62 (Act 16). If the sensor 4 has not yet detected the position detection mark 62 (No in Act 14), the control unit 20 returns to the process of Act 14.

The sensor position in Act 16 is specified based on the determined distance between the start mark 61 to the position detection mark 62 (as determined in the process of Acts 13 to 15). As described above, once the distance from the start mark 61 to the position detection mark 62 along the conveyance direction is known, the distance from paper edge for the sensor 4 (which detects the marks), is known (or easily calculable). That is, the sensor position can be specified by reference to the coordinate memory unit 32, which stores the correspondence between position detection mark 62 coordinate pairs (or the like).

After the sensor position has been specified, the control unit 20 next determines whether the sensor 4 detects another mark (the end mark 63) (Act 17). In this context, the control unit 20 considers that a mark detected by the sensor 4 after the position detection mark 62 has already been detected is the end mark 63. In other words, after the position detection mark 62 is detected, the next detection signal is input to the first acquisition unit 201 is considered by the control unit 20 to correspond to the end mark 63 being detected.

After it is determined that the sensor 4 detects the end mark 63 (Yes in Act 17), the control unit 20 determines that the position confirmation sheet 60 has been discharged from the thermal printer 1 after a predetermined period of time elapses and then stops the driving of the conveyance unit (Act 18) and ends the sensor position specifying process. If it is not determined that the sensor 4 has detected the end mark 63 (No in Act 17), the control unit 20 returns to the process of Act 17.

As described above, the thermal printer 1 of the first embodiment acquires the detection information obtained from a paper including a predetermined pattern that can be detected by the sensor 4, a print control unit 204 that controls a thermal head 5 and prints a mark corresponding to the position of sensor 4 at a width direction position specified based on the mark detection information, and a reception unit 206 that receives a correction to the print reference position. Therefore, by detecting the position detection mark 62 on the position confirmation sheet 60, the sensor position (provide as a distance from the reference paper guide 10) after the product assembly can be determined, and then a mark such as a straight vertical line along the conveyance direction can be printed at the sensor position previously specified (e.g., by design specification or the like) for the actually assembled/installed thermal head 5. Accordingly, the user can confirm whether there has been an assembly error with the thermal head 5 by comparing the printed mark (which is based on the design or expected position of the sensor relative to thermal head 5 position) with the specified sensor position (as measured using the position confirmation sheet 60 and the associated process described above).

If an assembly error of the thermal head 5 has occurred, the user can correct/adjust the print start position error thereby improving print quality. As for the configuration used for detecting the assembly error of the thermal head 5, the sensor 4, which is typically used for detecting the label positions, is generally already included in a thermal printer. Thus, increased device complexity and costs can be avoided.

After thermal printer 1 components are assembled, the user can identify the width direction position of the sensor 4 with respect to the reference paper guide 10. Therefore, if the position of the sensor 4 is not suitable and the marks 15 for the labels 14 cannot be recognized, the position of the sensor 4 can be corrected. When correcting the position of the sensor 4, the user performs this sensor position correction before the correction of the print reference position described above.

Second Embodiment

Figure 11:
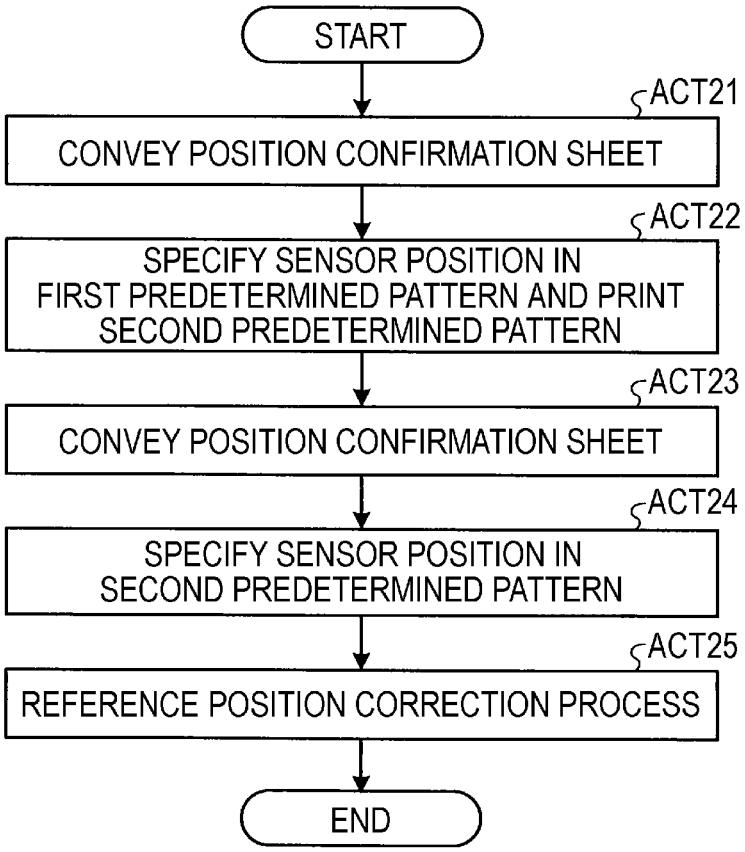
FIG. 11 is a flowchart of a correction process in a thermal printer of a second embodiment.
Figure 12:
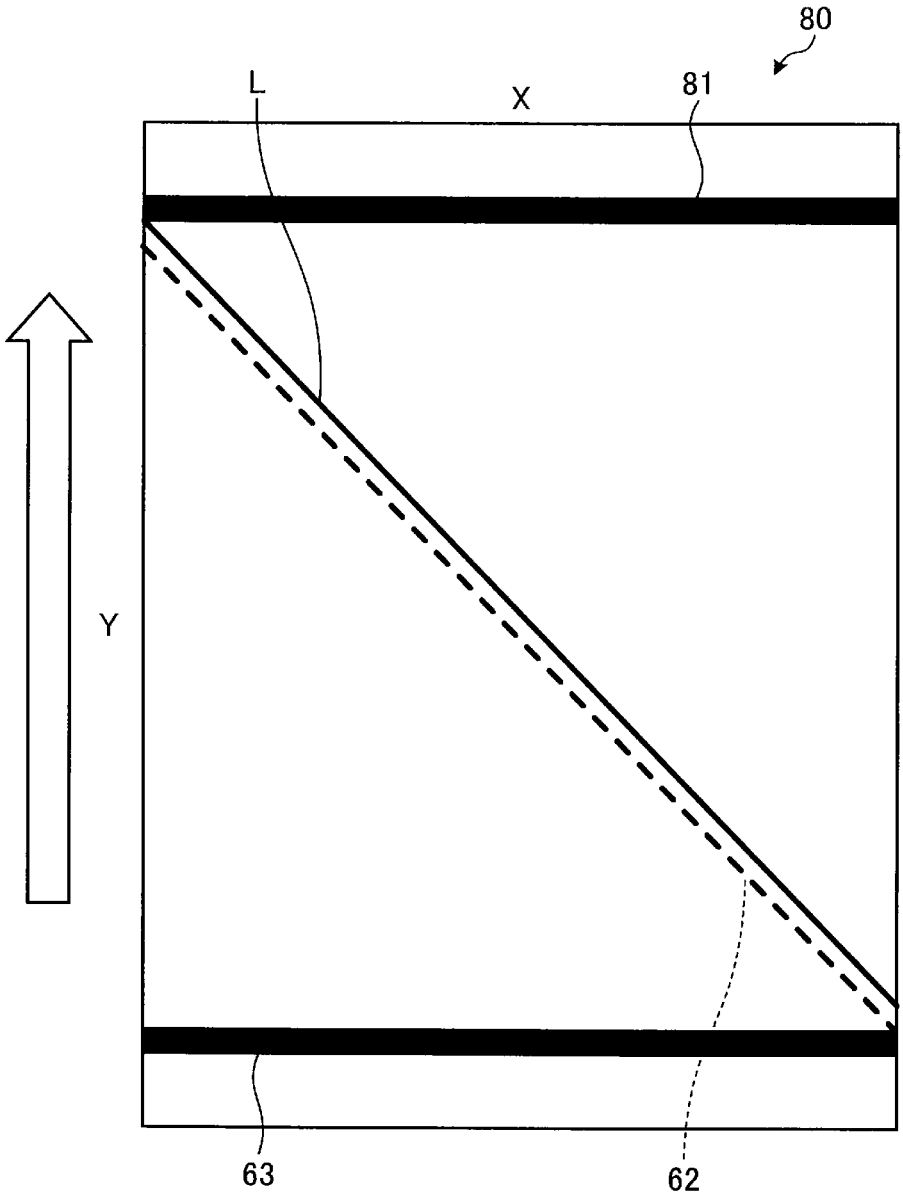
FIG. 12 depicts a printing result of a second predetermined pattern in a thermal head of a second embodiment.
Figure 13:
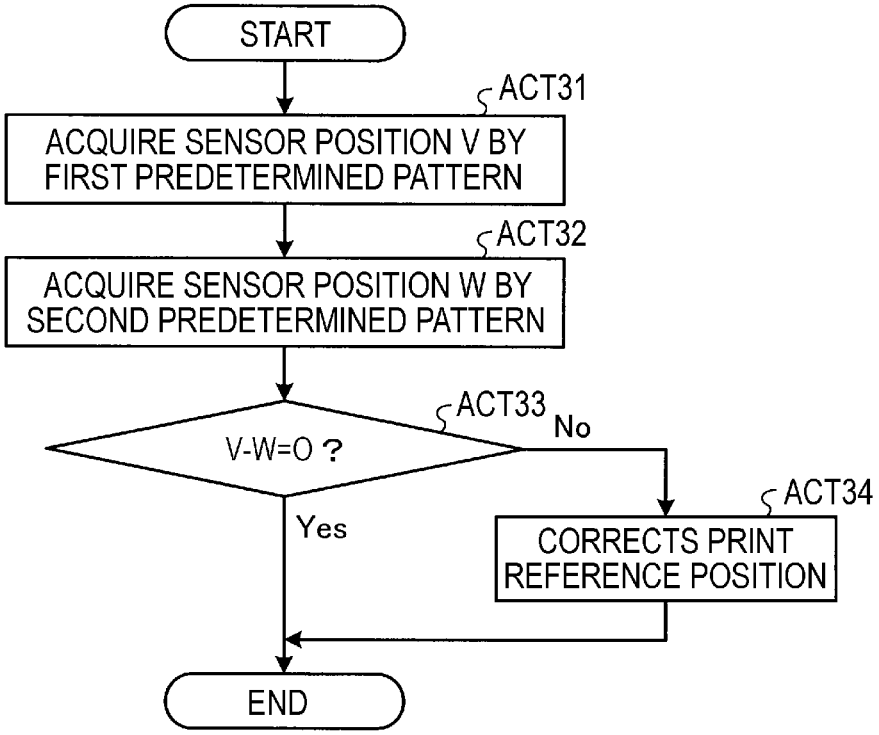
FIG. 13 is a flowchart of a process of a control unit according to a second embodiment.

A second embodiment is described with reference to FIGS. 11 to 13. While the user manually inputs the correction value for the print reference position according to the first embodiment, the print reference position can be automatically corrected by the thermal printer 1 according to the second embodiment. The difference from the first embodiment is the process by the control unit 20, and thus the other structure and aspects of the thermal printer 1 are not described again.

The flow of the correction process according to the second embodiment is described with reference to FIG. 11. In order to initiate the correction process, the user operates the operation unit 17 to start the correction process and loads or sets a position confirmation sheet 80 (see FIG. 12) to be conveyed by the conveyance unit (Act 21).

One surface of the position confirmation sheet 80 used in the second embodiment is as illustrated in FIG. 6 for position confirmation sheet 60. That is, one side of the portion confirmation sheet 80 includes the start mark 61, the position detection mark 62, and the end mark 63 that are printed in black similarly to position confirmation sheet 60. However, as illustrated in FIG. 12, on the other surface of the position confirmation sheet 80, which is the reverse side of the surface on which the first predetermined pattern has been printed, a start mark 81 and an end mark 82 are pre-printed in black to be at positions corresponding to the start mark 61 and end mark 62 on the opposite side. In FIG. 12, for convenience of description, a mark L of the second predetermined pattern that is printed by the thermal head 5 in the process Act 22 is already illustrated, but it should be noted that the mark L is not on the position confirmation sheet 80 until printed (in Act 22). That is, mark L is not pre-printed on the position confirmation sheet 80. For convenience in description, in FIG. 12, the position detection mark 62 printed on the front surface of position confirmation sheet is illustrated with as a dashed line, but this is for differentiation in the explanatory depiction and the actual position detection mark 62 may be a solid line (pre-printed on the front surface of the position confirmation sheet 80) and need not necessarily be visible/distinguishable when the backside of the position confirmation sheet 80 is viewed. In Act 21, the position confirmation sheet 80 is set so that one surface (front surface) that faces the sensor 4, and the other surface (back surface) faces the thermal head 5.

While conveying the position confirmation sheet 80 with the conveyance unit, the thermal printer 1 identifies the sensor position using the pre-printed first predetermined pattern and also prints the second predetermined pattern (Act 22) and discharges the position confirmation sheet 80. The specification of the sensor position in the first predetermined pattern is a process performed by the sensor 4 detecting the position detection mark 62 printed on front surface of the position confirmation sheet 80 to identify the position of the sensor 4 in the width direction. This sensor position specifying process is the same as that in the first embodiment, and thus the detailed description thereof is omitted.

The mark L is printed by thermal head 5 receiving an instruction, from the print control unit 204, for printing a diagonal line which is notionally at the same in position/coordinates as the position detection mark 62.

After the user extracts the discharged position confirmation sheet 80 with the mark L now printed thereon (on the backside of the sheet), the position confirmation sheet 80 can then be reset on the conveyance path such that the printed mark L from Act 22 now faces the sensor 4. The user then operates the operation unit 17 and the conveyance unit starts the conveyance of the position confirmation sheet 80 (Act 23). The thermal printer 1 performs the sensor position specifying process with the second predetermined pattern while conveying the position confirmation sheet 80 (Act 24). The sensor position specifying process with the second predetermined pattern is a process performed by the sensor 4 detecting the mark L that was printed on the other surface of the position confirmation sheet 80 with the thermal head 5 by specifying the (notional) position of the sensor 4 in the width direction.

The mark 62 of the first predetermined pattern is prepared in advance and is identical to the coordinate data stored for the position detection mark 62 in the coordinate memory unit 32. However, since the mark L of the second predetermined pattern is not prepared in advance, if there is an assembly error of the thermal head 5, the position of the mark L reflects the assembly error. In other words, the mark L position and the coordinate data stored in the coordinate memory unit 32 are not necessarily identical to each other. If the mark L and the coordinate data are not identical to each other, the sensor specified position using the second predetermined pattern will be different from the sensor specified position using the first predetermined pattern according to the assembly error (mispositioning) of the thermal head 5.

The thermal printer 1 can then perform the reference position correction process based on the difference between the sensor specified position using the first predetermined pattern and the sensor specified position using the second predetermined pattern (Act 25). The reference position correction process is further described with reference to the flowchart of FIG. 13.

First, the correction unit 207 acquires a sensor specified position V from the first predetermined pattern (as a distance from the reference paper guide 10) which is specified by the sensor position specifying unit 203 (Act 31). Next, the correction unit 207 acquires a sensor specified position W from the second predetermined pattern (as a distance from the reference paper guide 10) which is specified by the sensor position specifying unit 203 (Act 32).

The correction unit 207 then determines whether the sensor specified position V and the sensor specified position W are identical to each other (Act 33). If the positions are identical to each other (Yes in Act 33), it is determined that the assembly error of the thermal head 5 does not occur, and the reference position correction process ends. If the sensor specified position V and the sensor specified position W are not identical to each other (No in Act 33), the correction unit 207 corrects the reference position presently set in the reference position setting unit 205 (Act 34), and the reference position correction process ends.

As described above, according to the second embodiment, in addition to the effect of the first embodiment, there is an advantage of correcting the print reference position without a manual input or measurement by a user. Since the second predetermined pattern is printed while the sensor position specifying process is being performed with the first predetermined pattern, it is possible to efficiently perform the correction work.

According to the second embodiment, the print control of the mark L of the second predetermined pattern printed with the thermal head 5 is performed so as (notionally) to print the same mark as the position detection mark 62, but the present disclosure is not limited thereto. The print control of the mark L of the second predetermined pattern can be performed to print the mark L on the back surface of the position confirmation sheet, or the printing of mark L may be performed on a separate sheet before or after the detection of the position detection mark 62.

While certain embodiments have been described, these embodiments have been presented by way of example only, and are not intended to limit the scope of the inventions. Indeed, the embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A thermal printer, comprising:

a conveyance unit configured to convey paper along a conveyance direction;

a thermal head configured to perform printing on the paper at positions along a width direction of the paper intersecting the conveyance direction of the paper, the positions along the width direction being based on a preset print reference position;

a sensor positioned at a sensor position in the width direction and configured to detect marks on the paper being conveyed by the conveyance unit; and a controller configured to:

control the conveyance unit to convey a confirmation sheet along the conveyance direction;

detect a position of a first mark in a first predetermined pattern on the confirmation sheet with the sensor, the detected position of the first mark corresponding to the sensor position with respect to the preset print reference position;

control the conveyance unit to convey a sheet and the thermal head to print a second mark in a second predetermined pattern on the sheet, the second mark corresponding to pre-stored coordinates for the first mark and the printed position of the second mark being based on the preset print reference position;

detect a position of the printed second mark using the sensor; and update the preset print reference position based on a comparison of the detected position of the printed second mark to the detected position of the first mark.

2. The thermal printer according to claim 1, wherein the sensor is configured to detect leading edge marks for labels on the paper.

3. The thermal printer according to claim 1, wherein the sensor is a reflective sensor.

4. The thermal printer according to claim 1, further comprising:

an ink ribbon holding portion supplying an ink ribbon to the thermal print head; and an ink ribbon winding portion receiving the ink ribbon from the thermal print head.

5. The thermal printer according to claim 4, wherein the paper is a label roll.

6. The thermal printer according to claim 1, further comprising:

a pair of paper guides spaced from each other in the width direction.

7. The thermal printer according to claim 5, wherein the preset print reference position corresponds to an expected position of one of the pair of paper guides.

8. The thermal printer according to claim 6, the spacing between the pair of paper guides is adjustable.

9. The thermal printer according to claim 1, wherein the sheet on which the second mark of the second predetermined pattern is printed is the confirmation sheet.

10. A method for correcting printing positions of a thermal printer, the method comprising:

controlling a conveyance unit to convey a confirmation sheet along a conveyance direction;

detecting a position of a first mark in a first predetermined pattern on the confirmation sheet with a sensor, the detected position of the first mark corresponding to the sensor position with respect to a preset print reference position;

controlling the conveyance unit to convey a sheet and a thermal head to print a second mark in a second predetermined pattern, the second mark corresponding to pre-stored coordinates for the first mark and the printed position of the second mark being based on the preset print reference position;

detecting a position of the printed second mark using the sensor; and updating the preset print reference position based on a comparison of the detected position of the printed second mark to the detected position of the first mark.

11. The method according to claim 10, wherein the confirmation sheet and the sheet on which the second mark of the second predetermined pattern is printed are the same sheet.

* * * * *